United States Patent [19]

Yaari

[11] 4,437,365

[45] Mar. 20, 1984

[54] SCREWDRIVER

[76] Inventor: Yigal Y. Yaari, 42 Kirkwood Rd., Brighton, Mass. 02135

[21] Appl. No.: 356,203

[22] Filed: Mar. 8, 1982

[51] Int. Cl.[3] ..... B25G 1/00

[52] U.S. Cl. ..... 81/436; 145/61 L

[58] Field of Search ..... 81/436; 145/61 L

[56] References Cited

U.S. PATENT DOCUMENTS

| | | | |
|---|---|---|---|
| 814,020 | 3/1906 | Clifford | 81/177 G |
| 921,840 | 5/1909 | Jacobs | 145/61 R |
| 2,323,018 | 6/1943 | De Vellier | 81/436 |
| 2,484,765 | 10/1949 | Turgeon | 81/436 |
| 2,620,001 | 12/1952 | Fratz et al. | 145/61 L |
| 2,745,448 | 5/1956 | Leake | 145/61 L |
| 3,276,299 | 10/1966 | Halburian | 145/61 L |
| 3,289,503 | 12/1966 | Klatt | 81/436 |
| 3,424,212 | 1/1969 | Kemper | 81/436 |
| 3,738,768 | 6/1973 | Kuhn | 145/61 L |

FOREIGN PATENT DOCUMENTS

| | | | |
|---|---|---|---|
| 2117157 | 10/1972 | Fed. Rep. of Germany | 81/436 |

*Primary Examiner*—Frederick R. Schmidt
*Assistant Examiner*—J. T. Zatarga
*Attorney, Agent, or Firm*—Wolf, Greenfield & Sacks

[57] ABSTRACT

A screwdriver capable of being operated conventionally by the handle as a manual drive and alternatively being capable of being connected to a power drill so that it may be driven automatically. The screwdriver includes a conventional shank and tip at its end to engage the head of a screw. The handle has a coupling either permanently or removably attached to its top and which is adapted to fit into a conventional chuck of a power drill so as to connect the screwdriver to the power drill so that it may be driven automatically.

2 Claims, 8 Drawing Figures

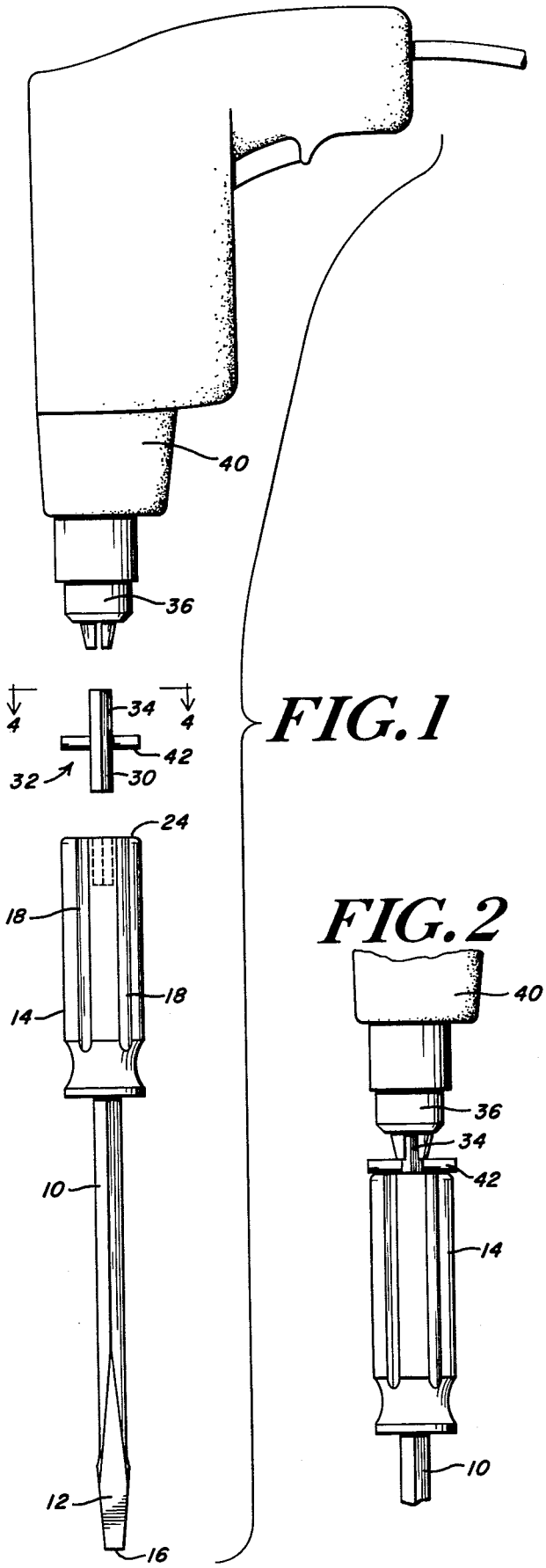
FIG. 1
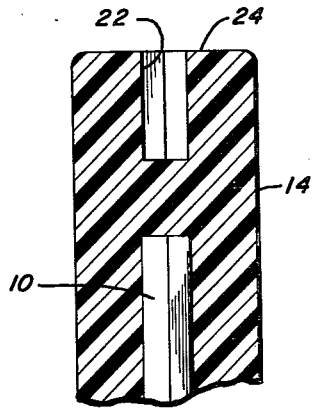
FIG. 3
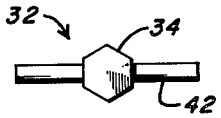
FIG. 4
FIG. 2
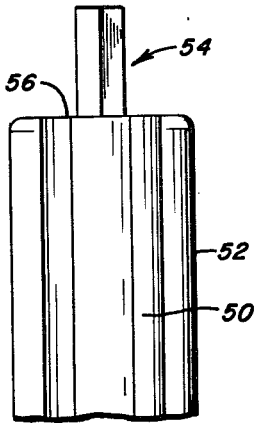
FIG. 5
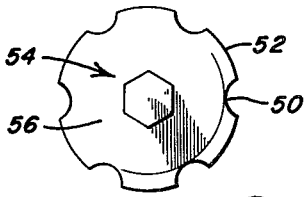
FIG. 6

SCREWDRIVER

INTRODUCTION

This invention relates to screwdrivers and more particularly comprises a new and improved screwdriver which is designed to be used either manually as a conventional screwdriver or be connected to a power drill so that it may be driven automatically.

There are a number of arrangements presently available which provide power-driven screwdrivers. However, none of these arrangements known to applicant provide means whereby an otherwise conventional screwdriver can be conveniently coupled to a power drill so that the screwdriver may be automatically power operated. A screwdriver capable of being used conventionally and which at the election of the user may be connected to a conventional one quarter or three eighths inch drill would provide a great convenience particularly to the homeowner or hobbyist who is not a professional carpenter or cabinet maker but who undertakes a variety of not too difficult wood working chores.

The principal object of this invention is to provide an inexpensive screwdriver which has the appearance of a conventional screwdriver and which may be used as a conventional screwdriver but which also may be connected at the election of the user to a power drill so that it may be operated automatically.

Another object of this invention is to provide an otherwise conventional screwdriver which may be conveniently coupled to a power drill for automatic use when desired.

To accomplish these and other objects, the screwdriver of this invention includes an essentially conventional shank and tip provided either with a knife edge or Phillips configuration so that it may engage the head of a screw and which also includes a handle that may be conventionally grasped to operate the screwdriver manually. The head is provided with a coupling at the top either fixed to or detachable from the handle and which may be coupled to a conventional chuck of a power drill so that at the election of the user it may be either manually or power operated.

These and other objects and features of this invention will be better understood and appreciated from the following detailed description of several embodiments thereof, selected for purposes of illustration and shown in the accompanying drawing, in which:

BRIEF FIGURE DESCRIPTION

FIG. 1 is an exploded view of a screwdriver and coupling constructed in accordance with this invention along with a power drill with which the screwdriver may be used;

FIG. 2 is a fragmentary side view showing the screwdriver secured to the drill;

FIG. 3 is a fragmentary cross sectional view of the screwdriver handle;

FIG. 4 is an end view of the coupling;

FIG. 5 is a fragmentary side view of the handle of another embodiment of screwdriver in accordance with this invention;

FIG. 6 is a top view of the screwdriver handle shown in FIG. 5; and

DETAILED DESCRIPTION

Figure 7:
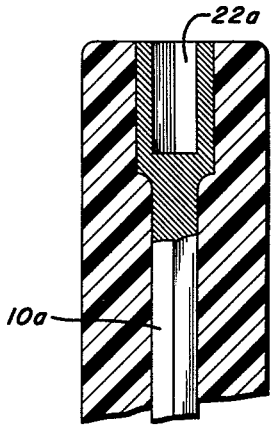
FIGS. 7 and 8 are fragmentary cross-sectional views showing other embodiments of this invention.

The screwdriver shown in FIG. 1 includes an essentially conventional shank 10 having a tip 12 and handle 14. The tip 12 shown in the drawing has a knife edge 16 designed to engage a single slotted head of a screw. It will be appreciated however that the tip 12 may take other forms such as for example that intended to engage the cross slot of a Phillips screw. The shank 10 with its tip 12 typically may be made of hardened steal or other suitable material.

Handle 14 which may be molded plastic or other like material is provided with axially extending grooves 18 on its surface to enable the handle to be gripped conveniently by the user. It will be appreciated that the screwdriver thus far described and shown may be used in the conventional manner to drive a screw.

In accordance with one embodiment of the invention shown in FIGS. 1–3, a well 22 extends axially in the handle from the top end 24. The well 22 is non-circular in shape and typically may be square, hexagonal or octagonal in cross section.

The well 22 is intended to receive one end 30 of coupling 32 used to connect the screwdriver to the power drill. While end 30 of the coupling is intended to fit into the well 22, end 34 of the coupling is designed to be engaged by chuck 36 of power drill 40, when the screwdriver is to be power driven. End 34 of the coupling may be of the same cross sectional configuration as end 30, or alternatively it may have a different configuration. The end 34 must, however, be of a configuration which is suitable to be connected to the chuck 36. Obviously if the ends 30 and 34 are identical, either end may fit into the handle and be received in the drill chuck. The particular cross section selected for such end of coupling 32 and well 22 is not critical, so long as there is sufficient frictional or mechanical interlocking of the coupling with the screw driver and drill to enable the drill to drive the screw driver.

In the preferred form, the coupling 32 includes a cross member or flange 42 disposed intermediate the ends 30 and 34. The flange 42 performs several functions. It may limit the depth of insertion of the ends 30 and 34 into the well 22 and chuck 36, respectively. In addition, the flange 42 may serve to protect the end 24 of the screwdriver handle by separating it from the nose of the chuck so that the handle does not become mared with continued use. The flange 42, however, is not an essential element of the coupling, but is preferred for the reasons stated. To protect the screw driver handle and omit the flange 42, the body of the coupling may of course be lengthened so that even with maximum penetration of the coupling in the chuck 36, the length of the coupling beyond the chuck exceeds the depth of the well 22 in the handle. If the coupling 32 is sufficiently long the handle 14 will not be able to engage the chuck 36.

FIG. 5 an alternative form of screwdriver is shown wherein the coupling is formed as an integral part of the screwdriver and is intended to remain in place whether or not used. In this embodiment, handle 50 is provided with axially extending grooves 52 on its surface just as are provided in the embodiment of FIG. 1, so that the screwdriver may be used manually in the conventional manner. Coupling 54 formed as an integral part of the handle extends upwardly from its top surface 56, and its cross section must be capable of being firmly engaged by the power drill chuck so the screw drive may be driven by it. It may be round or of some other configuration. The coupling 54 of course is designed to fit into the drill in the same manner as the end 34 of coupling 32. The coupling 54 is not so large as to interfere with the normal manual use of the screwdriver.

One advantage of the embodiment of FIGS. 5 and 6 over that of FIG. 1 is the absence of any loose parts which may be lost or misplaced. The disadvantage of the arrangement shown in FIGS. 5 and 6, however, is that the coupling is always present on the screwdriver and therefore may provide slight inconvenience, for example in the storage of the screwdriver, as it requires a storage compartment of greater length.

The well 22 in the first embodiment may either be formed in the plastic handle itself (as in FIG. 1) if the handle is made of sufficiently strong material so as to be capable of withstanding the forces to which it may be subjected by the coupling when the screwdriver is power driven. The well 22 may be lined with a particularly strong material if desired. Alternatively, the well 22 may be formed in the shank itself, which may extend upwardly the full length of the handle. That arrangement is suggested at 22*a* in FIG. 7. The shank 10*a* which is normally made of steal would, of course, provide sufficient strength to withstand the forces that may be encountered. Regardless of whether the well 22 is formed in the handle material or in the shank within the handle, it should have a close fit with the end 30 of the coupling so that rotation of the coupling by the drill will be imparted to the screwdriver without chattering. While the fit should be of rather close tolerance, in the preferred form the shank should be removable from the well 22 without the use of any tool for assistance.

Figure 8:
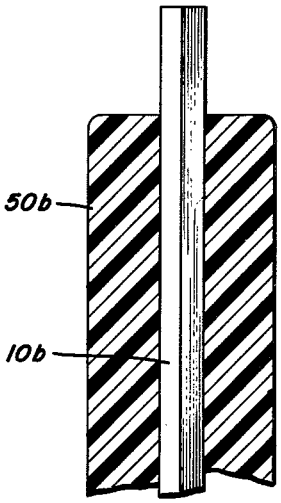

The coupling 54 shown in the embodiment of FIG. 5, may also either be formed as an integral part of the handle 50 as shown or be formed as part of the shank 102 which in turn extends through the handle 50*b* as in FIG. 8. Again, the arrangement used is dependent upon the materials from which the screwdriver is made.

Having described this invention in detail those skilled in the art will appreciate that numerous modifications may be made thereof without departing from its spirit. Therefore, I do not intend to limit the breadth of this invention to the embodiments illustrated and described. Rather, it is intended that the scope of this invention be determined by the appended claims and their equivalents.

What is claimed is:

1. A screwdriver capable of being operated manually or automatically comprising:

a shank, a tip formed at the free end of the shank adapted to engage the head of a screw, a handle permanently fixed on the other end of the shank by which the screwdriver may be operated manually, said handle having a well, non-circular in cross section, extending axially in the handle from the handle end remote from the shank, and a coupling having one end with a cross-sectional shape that conforms to the cross-section of the well and fitting snugly into the well but removable therefrom so that the screwdriver may be operated manually without interference from the coupling, said coupling having a second end that is adapted to be engaged by the chuck of a power drill so that the screwdriver may be powered by a power drill when the coupling is connected both to the power drill chuck and the handle.

2. A screwdriver as defined in claim 1 further characterized by:

a flange provided on the coupling intermediate its ends to limit the depth of insertion of the coupling into the chuck and prohibit the handle from engaging the chuck.

* * * * *